US010525476B2

(12) United States Patent
Kuvaja et al.

(10) Patent No.: US 10,525,476 B2
(45) Date of Patent: Jan. 7, 2020

(54) CRUSHER, MINERAL MATERIAL CRUSHING PLANT AND METHOD FOR HANDLING A THRUST BEARING IN A CRUSHER

(71) Applicant: Metso Minerals, Inc., Helsinki (FI)

(72) Inventors: Kari Kuvaja, Tampere (FI); Aki Lautala, Tampere (FI)

(73) Assignee: Metso Minerals, Inc., Helsinki (FI)

( * ) Notice: Subject to any disclaimer, the term of this patent is extended or adjusted under 35 U.S.C. 154(b) by 638 days.

(21) Appl. No.: 15/110,164

(22) PCT Filed: Jan. 12, 2015

(86) PCT No.: PCT/FI2015/050013
§ 371 (c)(1),
(2) Date: Jul. 7, 2016

(87) PCT Pub. No.: WO2015/104461
PCT Pub. Date: Jul. 16, 2015

(65) Prior Publication Data

US 2016/0325287 A1 Nov. 10, 2016

(30) Foreign Application Priority Data

Jan. 13, 2014 (FI) ..... 20145021

(51) Int. Cl.
*B02C 2/04* (2006.01)
*B02C 2/00* (2006.01)
*B02C 2/06* (2006.01)

(52) U.S. Cl.
CPC ..... *B02C 2/047* (2013.01); *B02C 2/00* (2013.01); *B02C 2/04* (2013.01); *B02C 2/06* (2013.01)

(58) Field of Classification Search
CPC .. B02C 2/00; B02C 2/04; B02C 2/047; B02C 2/06
(Continued)

(56) References Cited

U.S. PATENT DOCUMENTS 2,448,936 A * 9/1948 Van Zandt ..... B02C 2/06 241/215
3,372,881 A * 3/1968 Winter ..... B02C 2/04 241/208

(Continued)

FOREIGN PATENT DOCUMENTS

CN 1278193 A 12/2000
CN 1457403 A 11/2003

(Continued)

OTHER PUBLICATIONS

International Search Report for PCT/FI2015/050013 dated May 11, 2015.

(Continued)

*Primary Examiner* — Shelley M Self
*Assistant Examiner* — Jared O Brown
(74) *Attorney, Agent, or Firm* — Andrus Intellectual Property Law, LLP

(57) ABSTRACT

A crusher is disclosed having a rotatable eccentric, a main shaft supported to the eccentric, a piston for adjusting the vertical position of the main shaft and an axial thrust bearing between the lower end of the main shaft and the piston. The thrust bearing has an upper bearing attached to the lower end of the main shaft, a lower bearing attached to the piston, and a pressure plate between the upper bearing and the lower bearing. A circular groove or expansion is formed onto the pressure plate. A releasing member is attached to a crusher structure outside of the pressure plate. The releasing member has a circular lip directed to the direction of the pressure (Continued)

plate. Part of the lip is in the groove or above the part of the extension. The releasing member is attached to the piston.

14 Claims, 4 Drawing Sheets

(58) Field of Classification Search
USPC ..... 241/207–216; 29/235, 450, 525
See application file for complete search history.

(56) References Cited

U.S. PATENT DOCUMENTS

| | | | | |
|---|---|---|---|---|
| 3,384,312 | A * | 5/1968 | Patterson | B02C 2/04 241/208 |
| 3,413,047 | A * | 11/1968 | Levishko | F16C 19/10 384/197 |
| 3,666,188 | A * | 5/1972 | Lippmann | B02C 2/06 241/213 |
| 3,788,569 | A * | 1/1974 | Kemnitz | B02C 2/047 241/214 |
| 3,811,626 | A * | 5/1974 | Kemnitz | B02C 2/04 241/214 |
| 4,034,922 | A * | 7/1977 | Coxhill | B02C 2/06 241/213 |
| 5,779,166 | A | 7/1998 | Ruokonen et al. | |
| 6,328,237 | B1 * | 12/2001 | Thysell | B02C 2/047 241/213 |
| 2010/0155512 | A1 | 6/2010 | Persson et al. | |
| 2014/0097282 | A1 * | 4/2014 | Eriksson | B02C 2/047 241/215 |

FOREIGN PATENT DOCUMENTS

| | | | | |
|---|---|---|---|---|
| CN | 102256708 | A | 11/2011 | |
| DE | 1064322 | | 8/1959 | |
| DE | 1280639 | | 10/1968 | |
| WO | 9715396 | | 5/1997 | |
| WO | WO-2012140307 | A1 * | 10/2012 | B02C 2/047 |

OTHER PUBLICATIONS

Written Opinion for PCT/FI2015/050013 dated May 11, 2015.
Search Report for Finnish Application No. 20145021 dated Aug. 9, 2014.
Office Action for Chinese Patent Application No. 201580003907.6 dated Jan. 2, 2018.
Search Report for Chinese Patent Application No. 201580003907.6 dated Dec. 25, 2017.

* cited by examiner

CRUSHER, MINERAL MATERIAL CRUSHING PLANT AND METHOD FOR HANDLING A THRUST BEARING IN A CRUSHER

CROSS REFERENCE TO RELATED APPLICATIONS

The present application is the U.S. national stage application of International Application PCT/FI2015/050013, filed Jan. 12, 2015, and published in English on Jul. 16, 2015 as International Publication No. WO 2015/104461, which claims priority to FI Patent Application 20145021, filed Jan. 13, 2014, incorporated herein by reference.

FIELD OF TECHNOLOGY

The invention is related to a crusher with an axial thrust bearing supporting an eccentrically movable main shaft.

BACKGROUND

Mineral material such as stone is obtained from the soil for crushing either by exploding or by digging. Stone can be natural stone and gravel or building waste. Both movable and stationary crusher applications are used in crushing. The material for crushing is fed by an excavator or a wheel loader into the feed hopper of the crusher or crushing plant wherefrom the material to be crushed can fall into the jaw of the crusher, or the feeder can transfer the stone material toward the crusher. The mineral material for crushing can also be recyclable material such as concrete, brick or asphalt.

Gyratory and cone crushers are usually used after the jaw crusher for intermediate and fine crushing. In that case, the objective is to produce for example gravel or fine sand. Gyratory and cone crushers break up all stone types but not always recycled materials. Large primary cone crushers are used in mines in the primary crushing phase as well as in other mining and quarrying applications that demand large capacity.

A thrust bearing is arranged in the lower end of the vertically movable main shaft of the gyratory crusher, consisting of a lower bearing, an upper bearing and a pressure plate between the lower and upper bearing. In some cases, in connection with lifting the main shaft, the pressure plate has stuck onto the upper bearing through the oil membrane and fallen uncontrollably. The falling of the pressure plate has damaged the lower bearing or other structures.

WO9715396A1 presents a cone crusher with an axial thrust bearing.

The objective of the invention is to avoid or mitigate problems related to the field of technology and/or to provide new technical alternatives. An objective of the invention is to prevent damaging of the structures of the thrust bearing and the crusher in connection with lifting the main shaft.

SUMMARY

According to a first aspect of the present invention there is provided a crusher comprising a rotatable eccentric; a main shaft supported to the eccentric; a piston for adjusting the vertical position of the main shaft; and an axial thrust bearing arranged between the lower end of the main shaft and the piston, and which thrust bearing comprises an upper bearing attached to the lower end of the main shaft, a lower bearing attached to the piston, and a pressure plate with a circular groove or expansion, arranged between the upper bearing and the lower bearing; and the crusher comprises a releasing member attached to a crusher structure outside of the pressure plate, and the releasing member comprises a circular lip directed to the direction of the pressure plate, and a part of the lip is arranged in said groove or above the expansion.

Preferably, the groove or expansion is formed on the outer or inner perimeter of the pressure plate.

Preferably, the releasing member is attached to the piston.

Preferably, the attachment of the releasing member allows vertical movement of the releasing member in relation to the piston.

Preferably, the groove or expansion comprises a stopper surface directed upwards, and the lip comprises a lower surface directed towards the stopper surface, and part of the lip partially covers the stopper surface of the pressure plate overhead in positions during the crushing use.

Preferably, the releasing member is a uniform circular part arranged around the outer perimeter of the pressure plate.

Preferably, the releasing member is a combination of two or more parts which form a circular releasing member when attached to the structure of the crusher.

Preferably, the greatest outer diameter of the pressure plate is smaller than the smallest inner diameter defined by the lip of the outer releasing member when attached to the crusher.

Preferably, the releasing member is arranged inside the inner perimeter formed by the middle hole of the pressure plate.

Preferably, the smallest outer diameter of the middle hole of the pressure plate is greater than the greatest outer diameter defined by the lip of the inner releasing member.

Preferably, flow apertures are arranged in the releasing member for the flowing of lubrication oil.

According to a second aspect of the present invention, there is provided a crushing plant for mineral material, comprising a crusher according to an aspect or an embodiment of the invention.

According to a third aspect of the present invention there is provided a method for handling a thrust bearing in a crusher comprising a rotatable eccentric; a main shaft supported to the eccentric; a piston for adjusting the vertical position of the main shaft; and an axial thrust bearing arranged between the lower end of the main shaft and the piston, and which thrust bearing comprises an upper bearing attached to the lower end of the main shaft, a lower bearing attached to the piston, and a pressure plate arranged between the upper bearing and the lower bearing; and in the method, a releasing member is attached to a crusher structure outside of the pressure plate; a part of the circular lip of the releasing member is arranged onto a circular groove formed in the pressure plate or above a part of the expansion.

Preferably, the main shaft is lifted and the vertical ascending of the pressure plate along with the upper bearing attached to the main shaft is prevented with the releasing member.

Preferably, the pressure plate is guided with the releasing member to a desired central position when the pressure plate is mounted onto the lower bearing.

The upper bearing attached to the lower end of the main shaft of the crusher separates from the pressure plate when lifting the main shaft because the releasing member attached to the structure outside of the main shaft of the crusher prevents the ascending of the pressure plate with the upper bearing.

Various embodiments of the present invention are or have been illustrated with reference to one or some aspects of the invention. It is clear to a person skilled in the art that any embodiment of an aspect of the invention may be applied in the same aspect and other aspects either by itself or in connection with various other embodiments.

SHORT DESCRIPTION OF THE DRAWINGS

The invention will be described, by way of example only, with reference to the accompanying drawings.

DETAILED DESCRIPTION

In the following description like reference signs denote like parts. It should be realised that the presented figures are not in scale as a whole, and that they serve merely to illustrate the embodiments of the invention.

Figure 1:
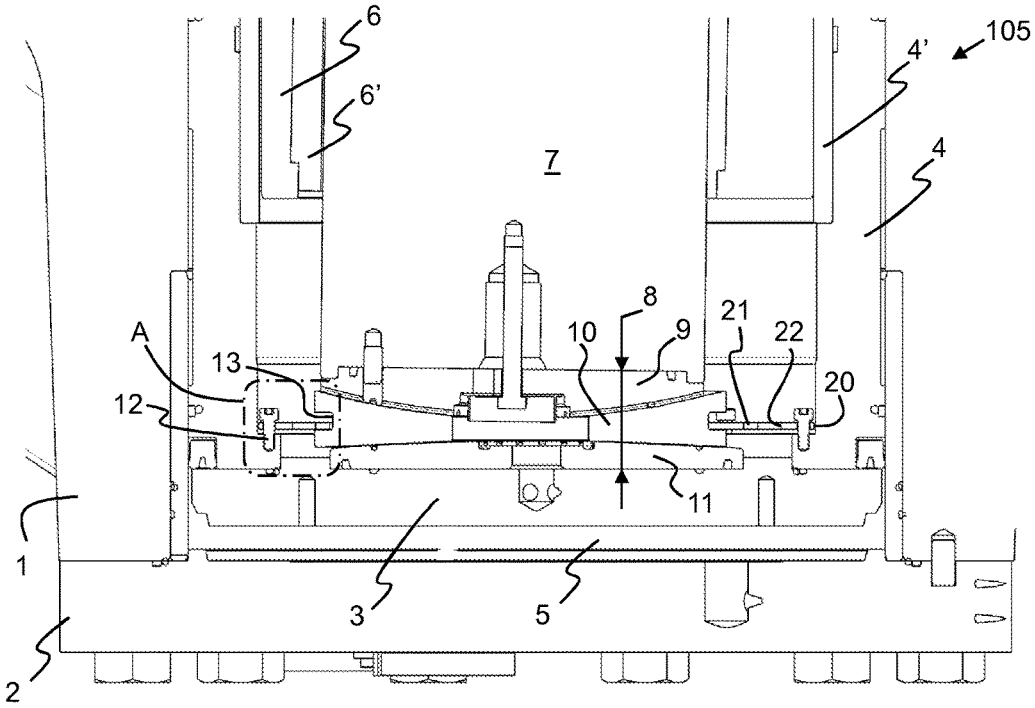
FIG. 1 shows a cross section of supporting of the lower end of a main shaft of a crusher with a thrust bearing, the pressure plate of which is detachable from the upper bearing with a releasing member according to a first preferable embodiment of the invention.

FIG. 1 shows a crusher 105, to a lower end of the body 1 of which a lid 2 is attached. The body and lid form a cylinder, inside which a vertically movable piston is arranged. FIG. 1 shows a piston 3 attached to a cylindrical wall 4, also called a guiding cylinder, the objective of which is to keep the piston straight. The objective of the guiding cylinder is also to enable inlet of oil through the wall of the cylinder for a thrust bearing and an eccentric. The piston is moved in the cylinder vertically by adjusting the amount of pressure medium such as hydraulic oil in a pressure medium space 5 between the piston 3 and the lid 2. In the figures, the piston is shown in a position lifted for a short distance from its lowest position. Inside the piston, the eccentric is equipped with bearings, comprising an eccentric shaft 6 and an eccentric bearing 6'. In an embodiment, in the eccentric shaft there is a hole inclined from the vertical direction, in which a main shaft 7 of the crusher 105 is equipped with bearings. A support cone is supported to the main shaft, to which support cone an exchangeable wear part or an inner blade (not shown in the figure) of the crusher is attached. Between an inner surface of the piston and an outer surface of the eccentric shaft there is a first radial bearing 4'. Between the inner surface of the eccentric shaft and the main shaft there is a second radial bearing, an eccentric bearing 6'. The eccentric shaft and eccentric bearing together form a desired eccentricity and the main shaft leans on the inclined hole that they form. Inclination and eccentricity can be arranged in both the eccentric shaft and bearing or merely either one of them. Preferably, the crusher is a gyratory crusher, the main shaft of which is also called a gyratory shaft.

Between a lower end of the main shaft 7 and an end 3 of the piston, a thrust bearing 8 is arranged, comprising an upper bearing 9, a pressure plate 10 and a lower bearing 11. The upper bearing 9 is attached to the lower end of the main shaft. The lower bearing 11 is attached to the piston, preferably to the end 3 of the piston. The pressure plate 10 stays between the upper and lower bearing during the using of the crusher because of the curved shapes of the opposite bearing surfaces of the upper bearing, pressure plate and lower bearing. When the elevation of the piston is changed, simultaneously the horizontal position is changed, and thus the pressure plate must be able to move freely in the guidance between the lower and the upper bearing surfaces. The upper surface of the pressure plate 10 is a concave spherical surface acting as a stopper surface for a convex spherical surface below the upper bearing 9. The lower surface of the pressure plate 10 is a concave spherical surface acting as a stopper surface for the convex spherical surface above the upper bearing 11. The thrust bearing 8 is lubricated with lubrication oil, led in the middle of an arrangement of thrust bearings 9, 10, 11, which lubrication oil is spread onto the bearing surfaces and leaves the thrust bearing sideways with the contribution of the grooves formed on the bearing surfaces of the upper and lower bearing.

The parts of the thrust bearing combined form a thrust bearing arrangement, supporting the main shaft 7 vertically. The thrust bearing arrangement allows the main shaft 7 to rotate around its axis of rotation when the main shaft is rotating in the bearing hole of the eccentric shaft 6, concurrently when the lower end of the main shaft is rotating with respect to the piston when the eccentric shaft is rotated.

The vertical movement of the support cone of the crusher is adjusted with the vertical movement of the piston 3, 4. The setting of the crusher, that is the smallest distance between the inner blade and the outer blade, can be adjusted by a vertical movement. An eccentric rotating movement is accomplished on the inner blade by rotating the eccentric shaft 6. The crushing impact is formed by rotating the eccentric shaft and the main shaft 7, supported diagonally via the eccentric shaft, the support cone attached onto the main shaft and the inner blade (the inner wear part) attached onto the support cone, with respect to the outer blade.

Figure 6:
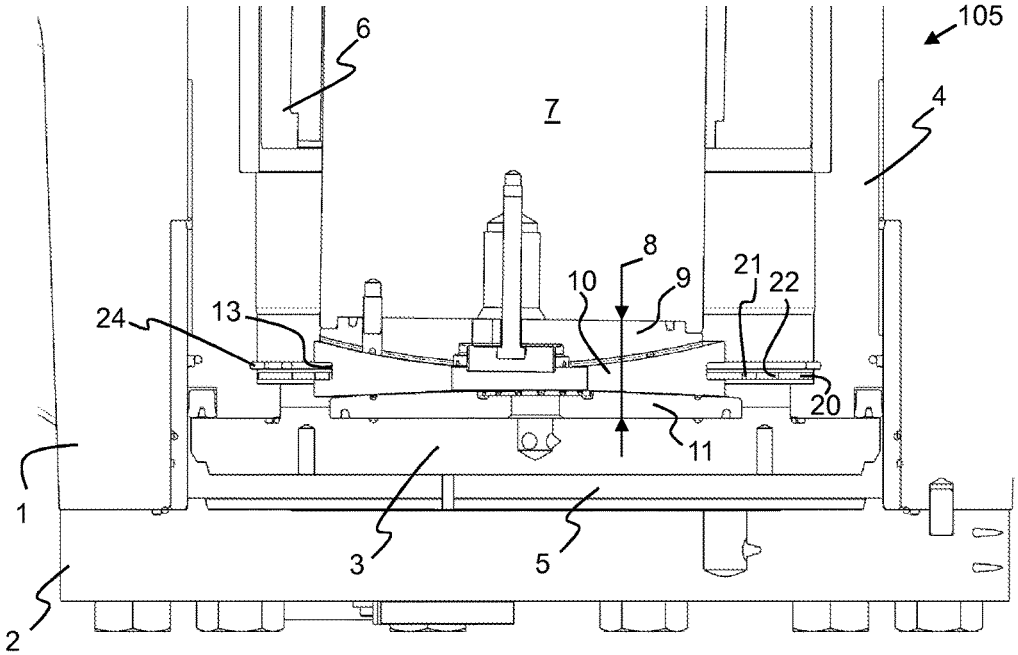
FIGS. 6 and 7 show alternative ways of attaching the releasing member of FIG. 1.
Figure 7:
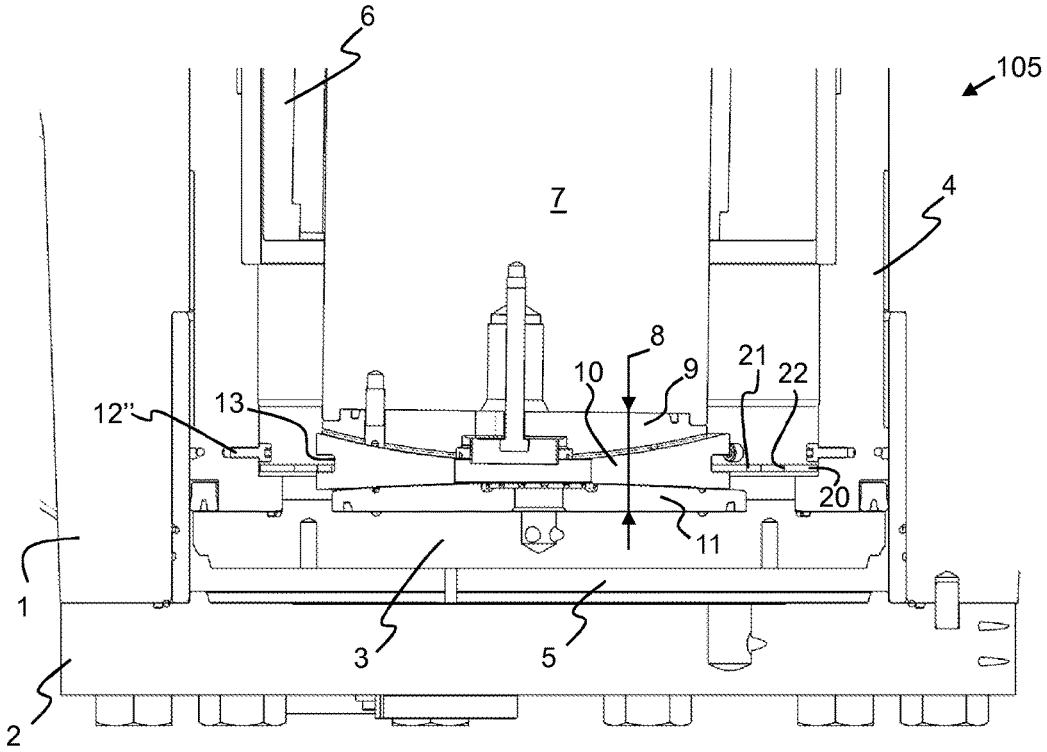

Inside the thrust bearing arrangement, a releasing member 20 is arranged, which in the example of FIG. 1 surrounds the pressure plate 10. In the crusher in FIG. 1, the releasing member is attached to the piston with screws 12, for instance with vertical screws 12 from the wall 4 of the piston to the protruding shoulder. The releasing member 20 can be mounted onto the crusher afterwards by forming mounting holes in the piston and threads for the screws 12. Preferably, the releasing member is attached to the same structure as the lower bearing. Preferably, the releasing member is attached to the structure of the crusher concentrically with the lower bearing. Alternative ways of attaching the releasing member to the piston are shown in FIGS. 6 and 7.

Preferably, the releasing member 20 is a uniform circular part arranged around the outer perimeter of the pressure plate. The releasing member can also be a combination of two or more parts, such as a combination of two or more circular parts such as segments, which combination when respectively attached to the structure of the crusher outside of the pressure plate forms a circular releasing member.

The releasing member around the pressure plate 10 comprises a lip 21 directed inside toward the pressure plate. In some cases, flow apertures 22 are arranged in the releasing member, such as vertical through holes for the flowing of the lubrication oil are arranged in the releasing member. The lip 21 of the releasing member prevents the pressure plate from the outer perimeter of ascending from underneath the releasing member. When the upper bearing 9 is lifted with the main shaft 7, the pressure plate 10 is detached from the upper bearing and stays over the bearing 11.

When mounting, the pressure plate is laid down concentrically through the orbicular (circular) releasing member 20. Preferably, the greatest outer diameter of the pressure plate 10 is smaller than the smallest inner diameter defined by the lip of the outer releasing member when attached to the crusher. In that case, the pressure plate can be detached from the crusher without separating the releasing member. Preferably, the lip 21 of the releasing member 20 covers overhead a part of the pressure plate (that is, a part of the groove 13 formed on the pressure plate or the stopper surface 10" of the expansion 10' directed upwards) preferably in positions of the pressure plate during the crushing use. The inner hole of the releasing member defined by the lip 21 of the releasing member 20 is preferably circular but also other orbicular shapes can be applied. The hole can consist of several subsequent areas with greater and smaller radius on the inner perimeter of the hole.

The pressure plate 10 comprises a groove 13 directed outwards on the outer perimeter (an expansion 10', FIG. 2) for the releasing member. The objective of the groove 13 (expansion) is to provide a place for the lip 21 of the releasing member, such that the functional movement parallel to the radius of the pressure plate as part of the thrust bearing is not limited. A further objective is to cover part of the stopper surface 10" of the groove (expansion) directed upwards from above on the lip surrounding the pressure plate.

Naturally, the stopper surface formed in the pressure plate for the releasing member can be solely the upper surface 10" of the expansion 10' formed in the outer perimeter of the pressure plate, and there is no groove and downwards directed surface in the groove above the lip.

Preferably, vertical movement of the releasing member in relation to the piston is allowed by the attachment of the releasing member. The vertical movability of the releasing member enables making the groove 13 of the pressure plate narrower. When the releasing member moves vertically, the releasing member can move downwards according to the wearing of the thrust bearing.

Figure 2:
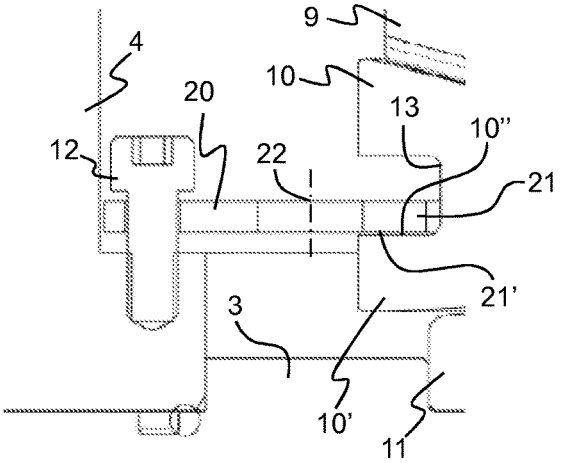
FIG. 2 shows a detail A in FIG. 1.

FIG. 2 shows a detail A in FIG. 1. The lower surface 21' of the lip 21 of the releasing member is above the upper surface 10" lying in the groove 13 (expansion 10') of the pressure plate, and prevents the pressure plate 10 from ascending higher than allowed by the attachment enabling movement of the releasing member. In FIG. 2, the releasing member 20 rests on the pressure plate 10. The height of the groove 13 is formed greater than the height of the lip 21, and a distance is arranged between the releasing member and the point of attachment in the piston, with which actions functioning of the releasing member can be improved during wearing of the thrust bearing 8 of the crusher.

Figure 3:
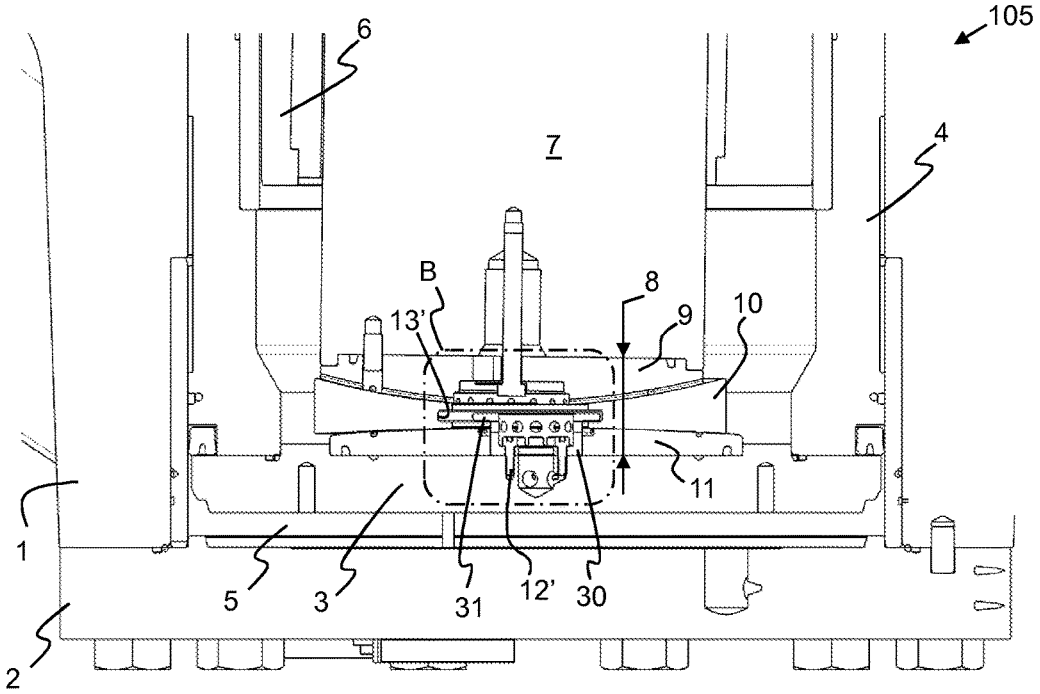
FIG. 3 shows a crusher equipped with a releasing member of the pressure plate according to a second preferable embodiment of the invention.

FIG. 3 shows a crusher 105, equipped with a releasing member 30 of the pressure plate 10, according to a second preferable embodiment of the invention. The crusher in FIG. 3 differs from the crusher in FIG. 1 concerning the arrangement of releasing members.

A releasing member 30 that is arranged inside the pressure plate 10, is arranged inside the arrangement of thrust bearings. In the crusher in FIG. 3, the releasing member is attached to the piston with screws 12', for instance with vertical screws 12' to the bottom 3 of the piston. Preferably, the releasing member is attached to the same structure as the lower bearing. Preferably, the releasing member is attached to the structure of the crusher concentrically with the lower bearing. The attachment of the releasing member can be arranged movable as shown in FIGS. 1 and 2, or stationary.

The releasing member 30 comprises a body attached to the piston from its lower end. The body of the releasing member comprises a flange in its upper end. The flange comprises a circular lip 31 directed outwards, which is surrounded by the pressure plate 10, and which lip reaches from some part of it onto the expansion 110 formed in the pressure plate, when the pressure plate is in the position during crushing use. A circular interior groove 113 is formed in the middle hole of the pressure plate in the preferable case in FIG. 3, through which the lubrication oil is led into the thrust bearing 8, but the expansion 110 can also be formed without the groove according to the description in FIG. 1.

Preferably, flow apertures 32 are arranged in the releasing member for the flowing of lubrication oil. The lip 31 of the releasing member prevents the pressure plate from the inner perimeter of not ascending from underneath the releasing member. When the upper bearing 9 is lifted with the main shaft 7, the pressure plate 10 is detached from the upper bearing and stays over the bearing 11. Preferably, the lip 31 of the releasing member 30 covers overhead part of the pressure plate in all positions during crushing use.

When mounting, the pressure plate is laid down concentrically around the releasing member 30. Preferably, the smallest outer diameter of the middle hole of the pressure plate is greater than the greatest outer diameter defined by the lip 31 of the releasing member 30. In that case, the pressure plate can be detached from the crusher without separating the releasing member.

The pressure plate 10 comprises a groove 113 directed inwards on the inner perimeter (an expansion 110, FIG. 4) for the releasing member 30. The objective of the groove 113 (expansion) is to provide a place for the lip 31 of the releasing member such that the functional movement parallel to the radius of the pressure plate as part of the thrust bearing is not limited. A further objective is to cover part of the stopper surface 110' of the groove (expansion) from above, on the lip surrounding the pressure plate.

Preferably, the vertical thickness of the lip of the releasing member 31 and the height of the groove 113 with respect to each other allow vertical movement of the pressure plate with respect to the piston, at which time the pressure plate can move downwards according to the wearing of the thrust bearing.

Figure 4:
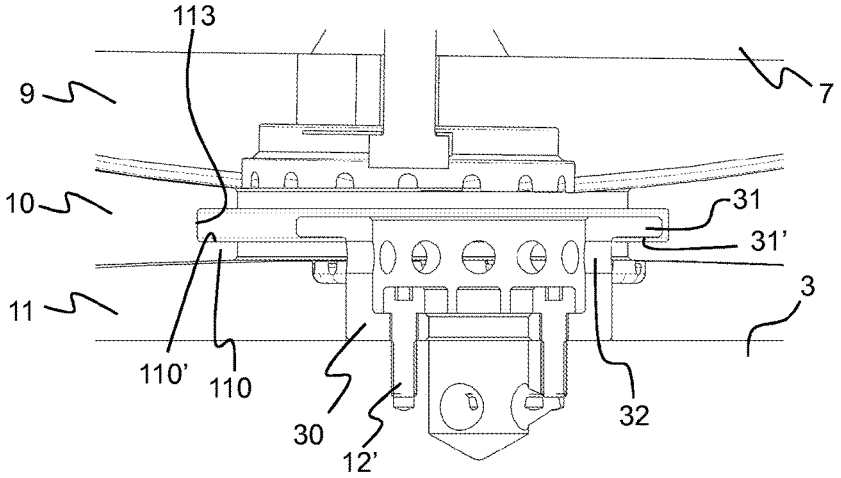
FIG. 4 shows a detail B in FIG. 3.

FIG. 4 shows a detail B in FIG. 3. The lower surface 31' of the lip 31 of the releasing member is above the stopper surface 110' lying in the groove 113 (expansion 110) of the pressure plate 10, and prevents the pressure plate 10 from ascending higher. In FIG. 2, the releasing member 20 rests on the pressure plate 10.

Figure 5:
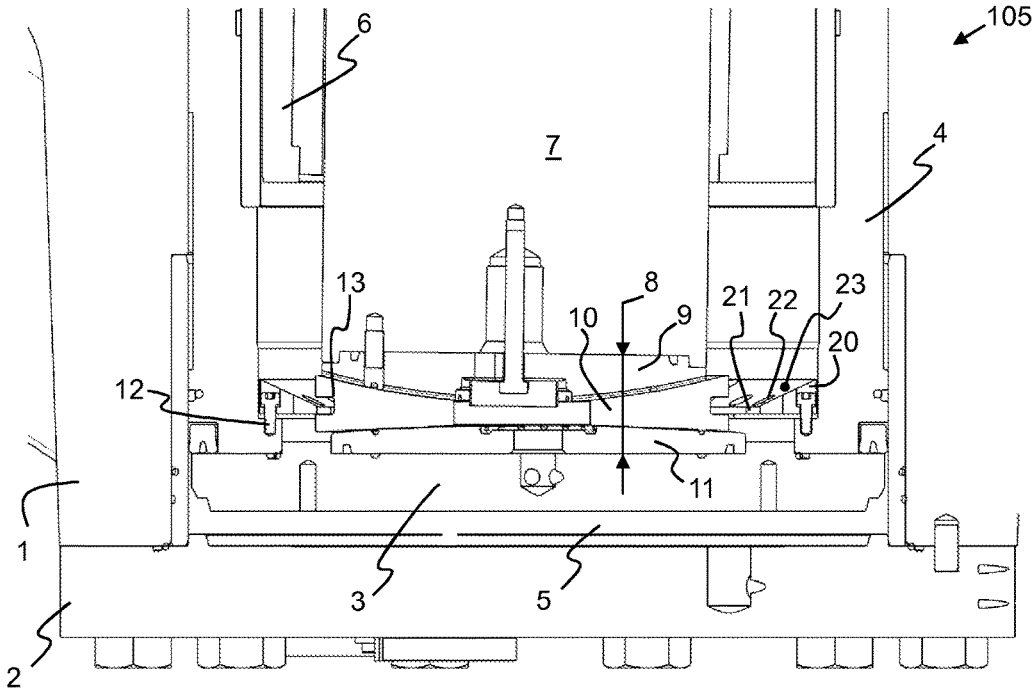
FIG. 5 shows a releasing member in the crusher according to a third preferable embodiment of the invention.

FIG. 5 shows a crusher 105, equipped with a releasing member 20 of the pressure plate 10, according to a third preferable embodiment of the invention. The crusher in FIG. 5 differs from the crusher in FIG. 1 concerning the cross section profile of the releasing member. The upper surface 23 of the crusher 20 is inclined downwards toward the pressure plate, that is inward in the middle of the piston. The inclined upper surface guides the pressure plate mounted in place to settle centrally onto the lower bearing, in which case faulty positions of the arrangement of thrust bearings can be avoided. Also when mounting a releasing member with higher cross section profile, a desired vertical mounting clearance can be achieved for instance by forming the immersion of the mounting screw deep enough.

FIG. 6 shows mounting of the releasing member 20 surrounding the pressure plate to the piston with a lock ring 24. The lock ring 24 is arranged into a groove formed on the wall 4 of the piston. The releasing member is arranged between the lock ring and a shoulder formed in the piston. With this way of mounting, a desired vertical space of movement and mounting clearance for the releasing member can be achieved, as well, as shown with screw mountings in FIGS. 1, 2 and 5.

FIG. 7 shows an alternative mounting of the releasing member 20 surrounding the pressure plate to the wall of the piston with vertically attached screws 12'. By choosing the distance of the screw head and the shoulder underneath the releasing member suitably, a desired vertical movement space and mounting clearance for the releasing member 20 can be achieved. This way of mounting can be applied in the after-mounting of the releasing member.

Figure 8:
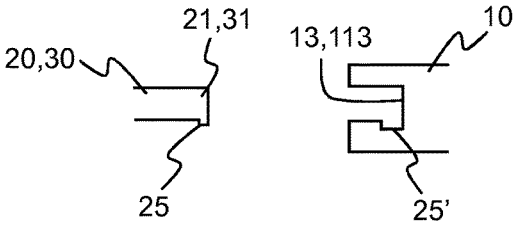
FIG. 8 shows the mating interaction between the releasing member and an inset of the pressure plate.

FIG. 8 shows how, according to some preferred embodiments, the lip 21, 31 of the releasing member 20, 30 comprises in the lower surface a hook-shaped form 25, which can be continuous or consist of separate areas below the lip or in at least some parts of the releasing member consisting of several parts can have a hook-shaped form. Responsively, the stopper surface of the pressure plate can have an inset 25' for the hook-shaped form 25. The hook-shaped form 25, and as its contra-shape, the inset 25', are formed to enhance detaching the pressure plate 10 from the upper bearing 9, when the hook-shaped form catches the inset.

Figure 9:
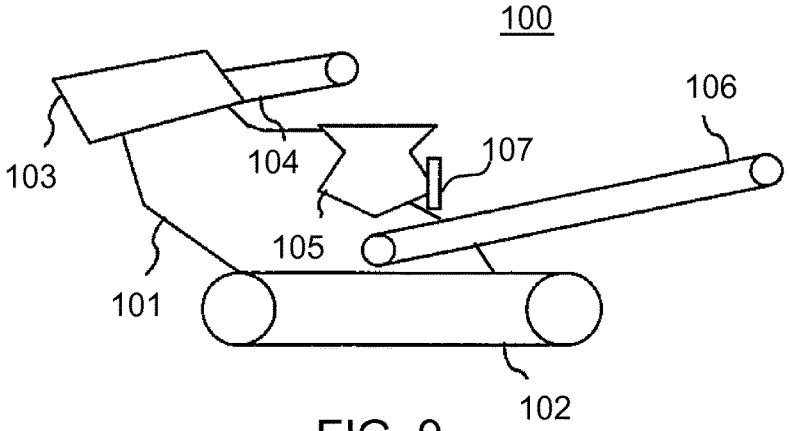
FIG. 9 shows a crushing plant of mineral material according to the invention, which crushing plant preferably comprises a crusher according to the invention.

FIG. 9 shows a crushing plant 100 for mineral material, suited for instance for open-pit mines for crushing stone material. The crusher 105 shown with the examples in FIGS. 1-8 can be used as a middle or secondary crusher. Specifically, the crusher can be used in fine crushing. The crushing plant comprises a body 101, onto which in this example a track base 102 is attached to enable independent movement. The crushing plant comprises a feeder 103 for feeding material for crushing, to the crusher 105. Preferably, the feeder also comprises a conveyor 104 and an emptying conveyor 106 for conveying the crushed material further, for instance to a heap beside the crushing plant. Further, the crushing plant can comprise a power source such as electric, diesel or other type of motor and transmission 107 from the power source to the crusher 105.

The feeder 103 can be a lamella conveyor, belt conveyor or vibration feeder which can also be screening, separating fine aggregate from the material to be crushed before crushing.

Instead of the track base 102, movement can be enabled with feet, skids or tires. When implemented with a track base, the crushing plant can be transported on road on a cradle or equivalent transportation arrangement. When implemented with tires, it can be pulled on road, preferably by a semi-trailer. In addition to the foregoing, the crushing plant can be a stationary crushing plant.

The crusher 105 in the crushing plant is a crusher according to an embodiment presented in the description, preferably a gyratory crusher or primary gyratory crusher.

In connection with maintenance of the crusher 105 in the crushing plant 100 and changing of the crushing cone in the upper end of the main shaft 7, the main shaft and support cone are lifted away from the crusher. The pressure plate 10 is detached from the bearing surface of the upper 9 bearing of the thrust bearing 8 already in connection with the lifting, caused by the releasing member 20, 30, and stays over the lower bearing 11 inside the crusher. In this case, falling of the pressure plate onto the lower bearing and other parts of the crusher during the lifting will not happen. In connection with the mounting, the pressure plate 10 can be directed onto the lower bearing 11 with the releasing member 20, 30. The pressure plate 10 takes the right position on the lower bearing to receive the main shaft being laid down onto the pressure plate and the upper bearing 9 attached to the lower end of the main shaft. The pressure plate 10 taking up a faulty position during mounting can be avoided with the releasing member, at which time for instance the main shaft takes up a position sufficiently centrally on the pressure plate instead of residing on the rim of the pressure plate too much on the side. Work safety is improved when falling of the pressure plate during lifting does not happen.

The foregoing description has provided non-limiting examples of some embodiments of the invention. It is clear to a person skilled in the art that the invention is not restricted to details presented above, but that it can be implemented using equivalent means.

Furthermore, some of the features of the above-disclosed embodiments may be used to advantage without the corresponding use of other features. As such, the foregoing description shall be considered as merely illustrative of the principles of the present invention, and not in limitation thereof. Hence, the scope of the invention is only restricted by the appended patent claims.

The invention claimed is:

1. A crusher comprising:

a rotatable eccentric;

a main shaft supported by the eccentric;

a piston for adjusting the vertical position of the main shaft; and an axial thrust bearing arranged between a lower end of the main shaft and the piston, wherein the thrust bearing comprises an upper bearing attached to the lower end of the main shaft, a lower bearing attached to the piston, and a pressure plate arranged between the upper bearing and the lower bearing, wherein:

a circular groove or expansion is formed onto the pressure plate;

the crusher comprises a releasing member, attached to a crusher structure inside of the pressure plate;

the releasing member comprises a circular lip directed to the direction of the pressure plate;

a part of the lip is arranged in said groove or above the expansion; and the releasing member is attached to the piston, wherein the releasing member is arranged inside a perimeter formed by a middle hole of the pressure plate and a smallest outer diameter of the middle hole of the pressure plate is greater than a greatest outer diameter defined by the lip of the releasing member.

2. A crusher according to claim 1, wherein the groove or the expansion is formed on an outer or inner perimeter of the pressure plate.

3. A crusher according to claim 1, wherein an attachment of the releasing member to the crusher structure allows vertical movement of the releasing member with respect to the piston.

4. A crusher according to claim 1, wherein:

the groove or the expansion comprises a stopper surface directed upwards;

the lip comprises a lower surface directed towards the stopper surface; and a part of the lip partially covers the stopper surface of the pressure plate during the crushing use.

5. A crusher according to claim 1, wherein the releasing member is a combination of two or more parts that form a circular releasing member when attached to the structure of the crusher.

6. A crusher according to claim 1, wherein flow apertures are arranged in the releasing member for the flowing of lubrication oil.

7. A crushing plant for mineral material, comprising a crusher according to claim 1.

8. A method for handling a thrust bearing in a crusher comprising a rotatable eccentric, a main shaft supported to the eccentric, a piston for adjusting the vertical position of the main shaft, and the thrust bearing arranged between the lower end of the main shaft and the piston, wherein the thrust bearing comprises an upper bearing attached to the lower end of the main shaft, a lower bearing attached to the piston, and a pressure plate arranged between the upper bearing and the lower bearing, the method comprising:

attaching a releasing member to a crusher structure inside of the pressure plate;

arranging a part of a circular lip of the releasing member in a circular groove formed on the pressure plate or above an expansion, wherein the releasing member is arranged inside a perimeter formed by a middle hole of the pressure plate and a smallest outer diameter of the middle hole of the pressure plate is greater than a greatest outer diameter defined by the lip of the releasing member; and attaching the releasing member to the piston.

9. A method according to claim 8, further comprising lifting the main shaft and preventing, via the releasing member, vertical ascending of the pressure plate along with the upper bearing attached to the main shaft.

10. A method according to claim 8, further comprising guiding the pressure plate, via the releasing member, to a desired central position when the pressure plate is mounted onto the lower bearing.

11. A crusher according to claim 3, wherein:

the groove or the expansion comprises a stopper surface directed upwards;

the lip comprises a lower surface directed towards the stopper surface; and a part of the lip partially covers the stopper surface of the pressure plate during the crushing use.

12. A crusher according to claim 3, wherein the releasing member is a combination of two or more parts that form a circular releasing member when attached to the structure of the crusher.

13. A crusher according to claim 3, wherein a greatest outer diameter of the pressure plate is smaller than a smallest inner diameter defined by a lip of the releasing member when attached to the crusher.

14. A crushing plant according to claim 7, wherein an attachment of the releasing member to the crusher structure allows vertical movement of the releasing member with respect to the piston.

* * * * *